US011331530B2

(12) United States Patent
Amyan

(10) Patent No.: US 11,331,530 B2
(45) Date of Patent: May 17, 2022

(54) MULTIPURPOSE PORTABLE GYM EQUIPMENT

(71) Applicant: Avetik Amyan, Brooklyn, NY (US)

(72) Inventor: Avetik Amyan, Brooklyn, NY (US)

( * ) Notice: Subject to any disclaimer, the term of this patent is extended or adjusted under 35 U.S.C. 154(b) by 42 days.

(21) Appl. No.: 16/742,360

(22) Filed: Jan. 14, 2020

(65) Prior Publication Data

US 2021/0060375 A1 Mar. 4, 2021

Related U.S. Application Data

(63) Continuation of application No. 15/950,776, filed on Apr. 11, 2018, now Pat. No. 10,583,317.

(60) Provisional application No. 62/485,508, filed on Apr. 14, 2017.

(51) Int. Cl.
*A63B 21/072* (2006.01)
*A63B 21/00* (2006.01)

(52) U.S. Cl.
CPC ..... *A63B 21/0722* (2015.10); *A63B 21/0728* (2013.01); *A63B 21/4035* (2015.10); *A63B 2210/50* (2013.01); *A63B 2210/58* (2013.01); *A63B 2225/093* (2013.01)

(58) Field of Classification Search
CPC ..... A63B 21/4035; A63B 2210/50
See application file for complete search history.

(56) References Cited

U.S. PATENT DOCUMENTS

| | | | | |
|---|---|---|---|---|
| 5,720,697 | A * | 2/1998 | Winkel | A63B 3/00 434/255 |
| 5,989,158 | A * | 11/1999 | Fredette | A63B 1/00 482/36 |
| D667,904 | S * | 9/2012 | DeFrancisci | D21/691 |
| D725,722 | S * | 3/2015 | Conaway | D21/679 |
| 9,675,829 | B1 * | 6/2017 | Katz | F16B 7/10 |
| 10,357,675 | B1 * | 7/2019 | Katz | F16B 19/109 |
| 2005/0209054 | A1 * | 9/2005 | Thomas Lebert | A63B 1/00 482/41 |

(Continued)

OTHER PUBLICATIONS

Oxford Lerner's Dictionary, "polygonal", retrieved Dec. 27, 2021, from https://www.oxfordlearnersdictionaries.com/us/definition/english/polygonal, pp. 1-3.

(Continued)

*Primary Examiner* — Joshua T Kennedy
(74) *Attorney, Agent, or Firm* — John J. Bamert, Esq.; Bamert Regan

(57) ABSTRACT

Embodiments are directed to an exercise equipment apparatus. The apparatus may comprise a lateral crossbeam, a first upward support member, and a first longitudinal support member. The first upward support member may have a proximal end portion and a distal end portion. The first upward support member may couple to the crossbeam. The first longitudinal support member may have two end portions. The first longitudinal support member may separably couple to the distal end portion of the first upward support member. Each of the two end portions of the first longitudinal support member may be sized and dimensioned to receive one or more weight plates and facilitate use of the first longitudinal support member as a weight-lifting bar when separated from the distal end portion of the first upward support member.

24 Claims, 10 Drawing Sheets

(56) References Cited

U.S. PATENT DOCUMENTS

| | | | | |
|---|---|---|---|---|
| 2006/0100075 | A1* | 5/2006 | Harsh | A63B 21/0783 482/142 |
| 2007/0010375 | A1* | 1/2007 | Corte | A63B 1/00 482/41 |
| 2010/0190612 | A1* | 7/2010 | Cook | A63B 71/023 482/38 |
| 2018/0104558 | A1* | 4/2018 | Sweeney | A63B 71/023 |
| 2020/0261764 | A1* | 8/2020 | Sullivan | A63B 71/06 |

OTHER PUBLICATIONS

SoftSchools.com, "Static Friction Formula", retrieved Dec. 27, 2021, from https://www.softschools.com/formulas/physics/static_friction_formula/30/, pp. 1-2.

* cited by examiner

MULTIPURPOSE PORTABLE GYM EQUIPMENT

CROSS-REFERENCE TO RELATED APPLICATIONS

This application is a continuation of U.S. application Ser. No. 15/950,776, entitled "Multipurpose portable gym equipment," filed 11 Apr. 2018, which claims the benefit of U.S. Provisional Application No. 62/485,508, entitled "Multipurpose portable gym equipment," filed 14 Apr. 2017, each of which is incorporated herein by reference in its entirety.

FIELD OF THE INVENTION

This application relates to gym equipment and, more particularly, yet not exclusively, collapsible multipurpose gym equipment.

BACKGROUND OF THE INVENTION

To engage each of a user's major muscle groups, the user typically employs a variety of pieces of workout equipment. Typical workout equipment often includes free weights in combination with other structures, such as pull-up bars, that are either fixedly coupled to buildings or integrated in large, heavy workout machinery. The quantity and size of the pieces of workout equipment precludes practical portability in normal activities, such as business traveling from hotel to hotel. Workout equipment that is not fixedly coupled to buildings or integrated in large, heavy workout machinery typically fails to permit the user to exercise each of the user's major muscle groups, lacks the stability required to allow the user to confidently workout, is challenging to use, and is expensive. Thus, it is with regard to these considerations and others that the present invention has been made.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Preferred Embodiment, which is to be read in association with the accompanying drawings, wherein.

SUMMARY OF THE INVENTION

Figure 1:
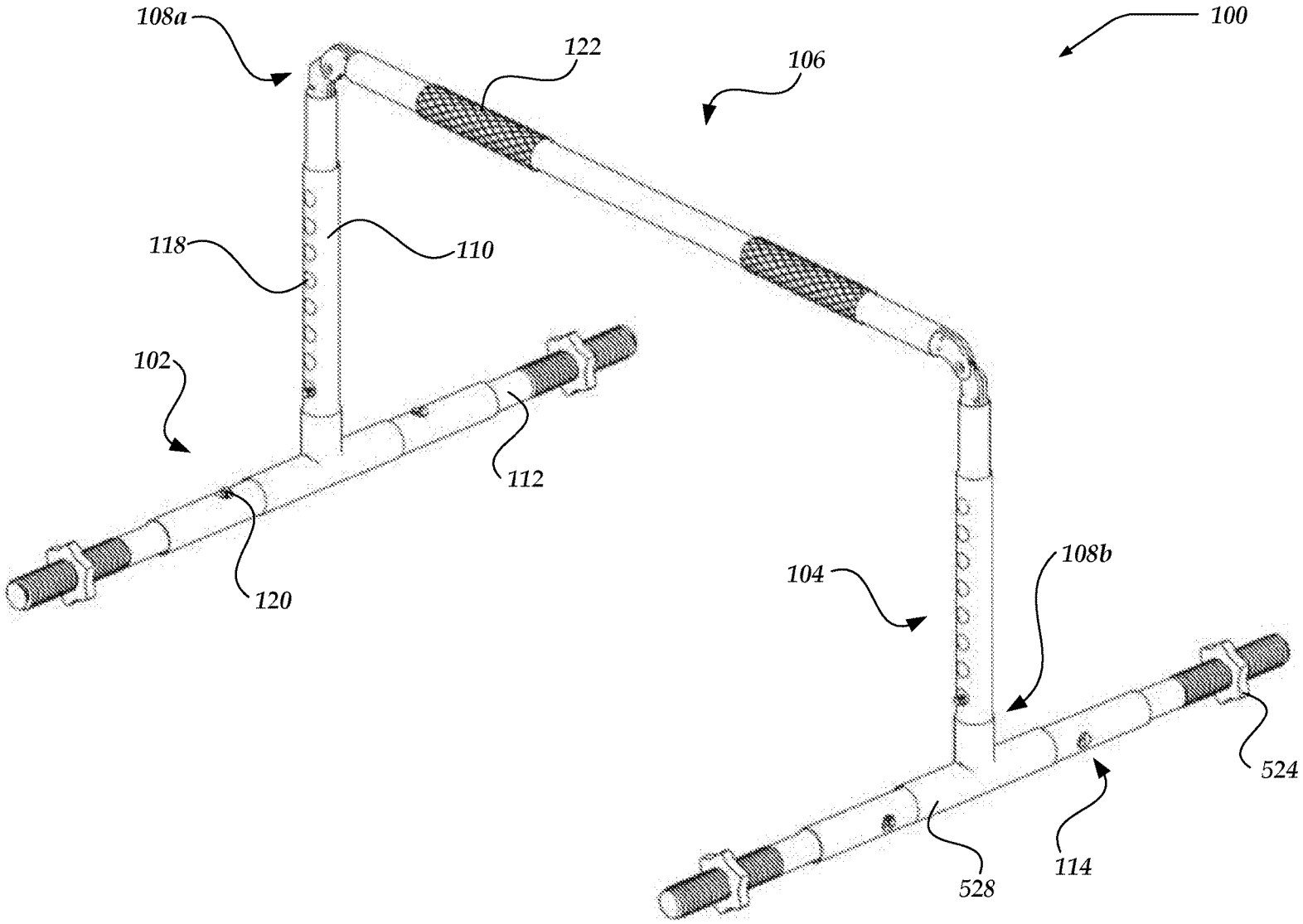
FIG. 1 shows an isometric view of an example exercise apparatus having upward and longitudinal tubular support members and a lateral tubular crossbeam, with the apparatus in a deployed configuration and each of the support members in a shortened configuration.

The following briefly describes example embodiments of the invention in order to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to an exercise equipment apparatus. In one or more of the various embodiments, the exercise equipment apparatus may include a lateral crossbeam, a first upward support member, and a first longitudinal support member. In some of the various embodiments, the first upward support member may have a proximal end portion and a distal end portion. In some embodiments, the first upward support member may couple to the crossbeam. In some embodiments, the first longitudinal support member may have two end portions. In some embodiments, the first longitudinal support member may separably couple to the distal end portion of the first upward support member. In some embodiments, each of the two end portions of the first longitudinal support member may be sized and dimensioned to receive one or more weight plates and facilitate use of the first longitudinal support member as a weight-lifting bar when separated from the distal end portion of the first upward support member.

In one or more of the various embodiments, the apparatus may further include two collars coupling to respective ones of the end portions of the first longitudinal support member and securing the one or more weight plates to the first longitudinal support member.

In one or more of the various embodiments, the two end portions of the first longitudinal support member may be threaded and may facilitate receiving one or more collars that secure the one or more weight plates to the first longitudinal support member.

In one or more of the various embodiments, the first longitudinal support member may have a middle portion disposed between the two end portions of the first longitudinal support member. In some of the various embodiments, the middle portion of the first longitudinal support member may abut one or more of the two end portions of the first longitudinal support member. In some embodiments, the one or more of the two end portions of the first longitudinal support member may have a first outer diameter. In some embodiments, the middle portion of the first longitudinal support member may have a second outer diameter that is larger than the first outer diameter of the one or more of the two end portions of the first longitudinal support member and that may facilitate securing the one or more weight plates between the middle portion and one or more collars received on the one or more of the two end portions of the first longitudinal support member.

In one or more of the various embodiments, the first longitudinal support member may have one or more handgrips.

In one or more of the various embodiments, the first longitudinal support member may have one or more telescoping tubes and one or more extension locks that, in an unlocked configuration, permit extending or shortening the one or more telescoping tubes and that, in a locked configuration, prevent extending or shortening the one or more telescoping tubes.

In one or more of the various embodiments, the first longitudinal support member may have one or more telescoping tubes. In some of the various embodiments, each telescoping tube may have an inner tube and an outer tube. In some embodiments, the outer tube may at least partially house the inner tube. In some embodiments, the inner tube may have one or more handgrips.

In one or more of the various embodiments, the first upward support member may have one or more telescoping tubes and one or more extension locks that, in an unlocked configuration, permit extending or shortening the one or more telescoping tubes and that, in a locked configuration, prevent extending or shortening the one or more telescoping tubes.

In one or more of the various embodiments, the first upward support member may hingeably couple to the crossbeam and may facilitate transitioning the exercise equipment apparatus between a deployed configuration and a collapsed configuration. In some of the various embodiments, the exercise equipment apparatus may have a smaller form factor in the collapsed configuration.

In one or more of the various embodiments, the lateral crossbeam may have one or more handgrips.

In one or more of the various embodiments, the apparatus may further include a second upward support member and a second longitudinal support member. In some of the various embodiments, the second upward support member may have a proximal end portion and a distal end portion. In some embodiments, the crossbeam may have a first end portion and a second end portion. In some embodiments, the first upward support member may couple to the first end portion of the crossbeam. In some embodiments, the second upward support member may couple to the second end portion of the crossbeam. In some embodiments, the second longitudinal support member may have two end portions. In some embodiments, the second longitudinal support member may separably couple to the distal end portion of the second upward support member. In some embodiments, each of the two end portions of the second longitudinal support member may be sized and dimensioned to receive one or more weight plates and may facilitate use of the second longitudinal support member as a weight-lifting bar when separated from the distal end portion of the second upward support member.

Also briefly stated, various embodiments are directed to a method of exercising. In one or more of the various embodiments, the exercise equipment apparatus may be provided. In some of the various embodiments, the first longitudinal support member may be coupled to the distal end portion of the first upward support member. In some embodiments, the crossbeam may be gripped with the first longitudinal support member coupled to the distal end portion of the first upward support member. In some embodiments, the gripped crossbeam may be repeatedly pulled or pushed to repeatedly move a human body toward or away from the crossbeam with the first longitudinal support member coupled to the distal end portion of the first upward support member. In some embodiments, the first longitudinal support member may be separated from the distal end portion of the first upward support member. In some embodiments, the one or more weight plates may be coupled to the first longitudinal support member with the first longitudinal support member separated from the distal end portion of the first upward support member. In some embodiments, the first longitudinal support member may be gripped with the first longitudinal support member separated from the distal end portion of the first upward support member and with the one or more weight plates coupled to the first longitudinal support member. In some embodiments, the gripped first longitudinal support member may be repeatedly employed to perform one or more weight-lifting exercises with the first longitudinal support member separated from the distal end portion of the first upward support member and with the one or more weight plates coupled to the first longitudinal support member.

In one or more of the various embodiments, the exercise equipment apparatus may further include one or more collars that may be sized and dimensioned to be received on one or more of the two end portions of the first longitudinal support member. In some of the various embodiments, the first longitudinal support member may have a middle portion disposed between the two end portions of the first longitudinal support member. In some embodiments, the middle portion of the first longitudinal support member may abut the one or more of the two end portions of the first longitudinal support member. In some embodiments, the one or more of the two end portions of the first longitudinal support member may have a first outer diameter. In some embodiments, the middle portion of the first longitudinal support member may have a second outer diameter that is larger than the first outer diameter of the one or more of the two end portions of the first longitudinal support member and that facilitates securing the one or more weight plates between the middle portion and the one or more collars received on the one or more of the two end portions of the first longitudinal support member. In some embodiments, the one or more weight plates may be slid onto the one or more of the two end portions of the first longitudinal support member. In some embodiments, the one or more collars may be coupled to the one or more of the two end portions of the first longitudinal support member.

In one or more of the various embodiments, the first longitudinal support member may have one or more telescoping tubes and one or more extension locks that, in an unlocked configuration, permit extending or shortening the one or more telescoping tubes and that, in a locked configuration, prevent extending or shortening the one or more telescoping tubes. In some of the various embodiments, repeatedly employing the gripped first longitudinal support member to perform the one or more weight-lifting exercises may include repeatedly employing the gripped first longitudinal support member to perform the one or more weight-lifting exercises with the first longitudinal support member separated from the distal end portion of the first upward support member, with the one or more weight plates coupled to the first longitudinal support member, and with the one or more telescoping tubes fully extended.

In one or more of the various embodiments, the first longitudinal support member may have one or more telescoping tubes. In some of the various embodiments, each telescoping tube may have an inner tube and an outer tube. In some embodiments, the outer tube may at least partially house the inner tube. In some embodiments, the inner tube may have one or more handgrips. In some embodiments, gripping the first longitudinal support member may include fully extending each telescoping tube to expose one or more portions of each handgrip and gripping the first longitudinal support member with the first longitudinal support member separated from the distal end portion of the first upward support member, with the one or more weight plates coupled to the first longitudinal support member, and with each telescoping tube fully extended.

In one or more of the various embodiments, the first upward support member may have one or more telescoping tubes and one or more extension locks that, in an unlocked configuration, permit extending or shortening the one or more telescoping tubes and that, in a locked configuration, prevent extending or shortening the one or more telescoping tubes. In some of the various embodiments, repeatedly pulling or pushing on the gripped crossbeam to repeatedly move the human body toward or away from the crossbeam may include repeatedly pulling or pushing on the gripped crossbeam to repeatedly move the human body toward or away from the crossbeam with the first longitudinal support member coupled to the distal end portion of the first upward support member and with the one or more telescoping tubes fully extended.

In one or more of the various embodiments, the first upward support member may hingeably couple to the crossbeam and may facilitate transitioning the exercise equipment apparatus between a deployed configuration and a collapsed configuration. In some of the various embodiments, the exercise equipment apparatus may have a smaller form factor in the collapsed configuration. In some embodiments, repeatedly pulling or pushing on the gripped crossbeam to repeatedly move the human body toward or away from the crossbeam may include transitioning the exercise equipment apparatus from the collapsed configuration to the deployed configuration and repeatedly pulling or pushing on the gripped crossbeam to repeatedly move the human body toward or away from the crossbeam with the first longitudinal support member coupled to the distal end portion of the first upward support member and with the exercise equipment apparatus in the deployed configuration.

DETAILED DESCRIPTION OF THE PREFERRED EMBODIMENT

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

The term "portable" as used herein refers to the size and weight of an element being sufficiently small that the average adult human can carry the element with a single hand without external assistance, such as assistance of a tool, machinery, or another human.

FIG. 1 shows an isometric view of example exercise apparatus 100 in a deployed configuration. In one or more of the various embodiments, apparatus 100 may have one or more longitudinal tubular support members 102. In some of the various embodiments, one or more upward tubular support members 104 may extend upward from one or more longitudinal support members 102. In some embodiments, one or more lateral tubular crossbeams 106 may extend from one or more upward support members 104 to one or more other upward support members 104. In some embodiments, each upward support member 104 may have one or more proximal end portions and one or more distal end portions. In some embodiments, one or more distal end portions of one or more upward support members 104 may separably or hingeably couple to one or more middle portions of one or more longitudinal support members 102. In some embodiments, one or more lateral crossbeams 106 may separably or hingeably couple to one or more proximal end portions of one or more upward support members 104. In some embodiments, one or more separable or hingeable couplings 108 may facilitate collapsing apparatus 100 from the deployed configuration to a collapsed configuration (see, for example, FIG. 10) or deploying apparatus 100 from the collapsed configuration to the deployed configuration to provide a highly portable system, as well as increase the number of different exercises that may be performed with apparatus 100. In some embodiments, apparatus 100 in the deployed configuration or the collapsed configuration may be portable to facilitate relatively easy transport or storage of apparatus 100.

Figure 3:
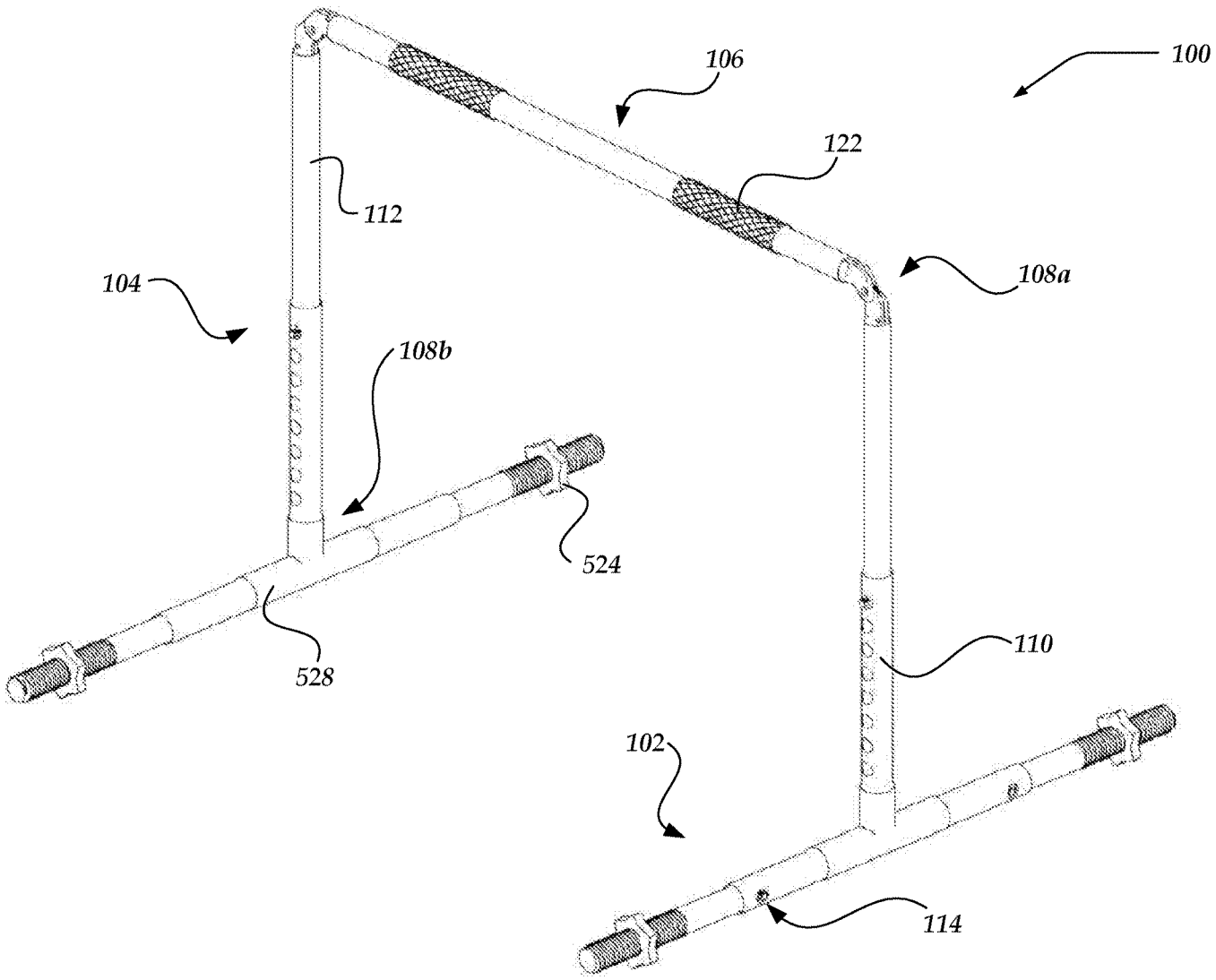
FIG. 3 shows an isometric view of the exercise apparatus of FIG. 1 with the upward support members in the extended configuration.
Figure 4:
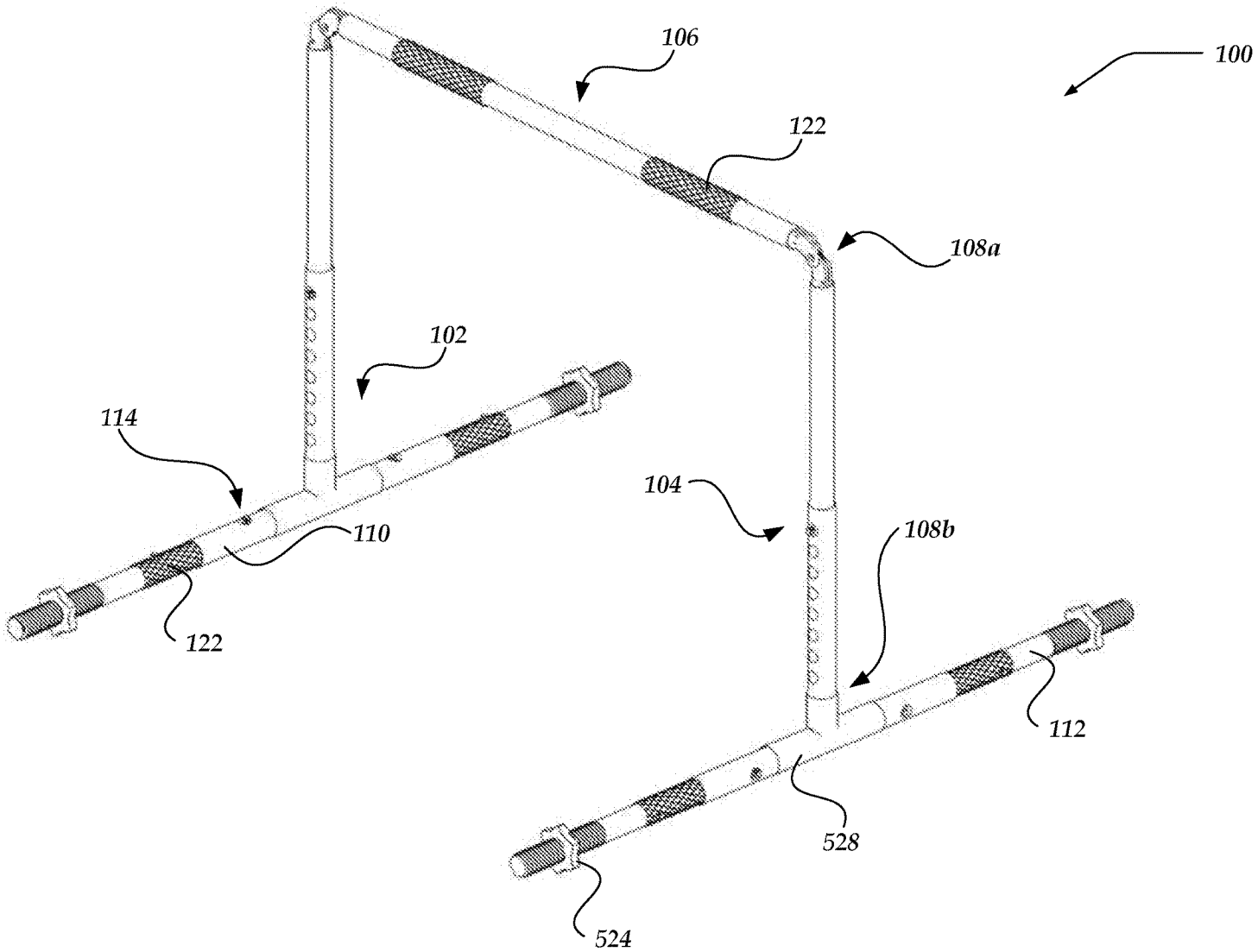
FIG. 4 illustrates an isometric view of the exercise apparatus of FIG. 1 with the upward and longitudinal support members in an extended configuration.
Figure 5:
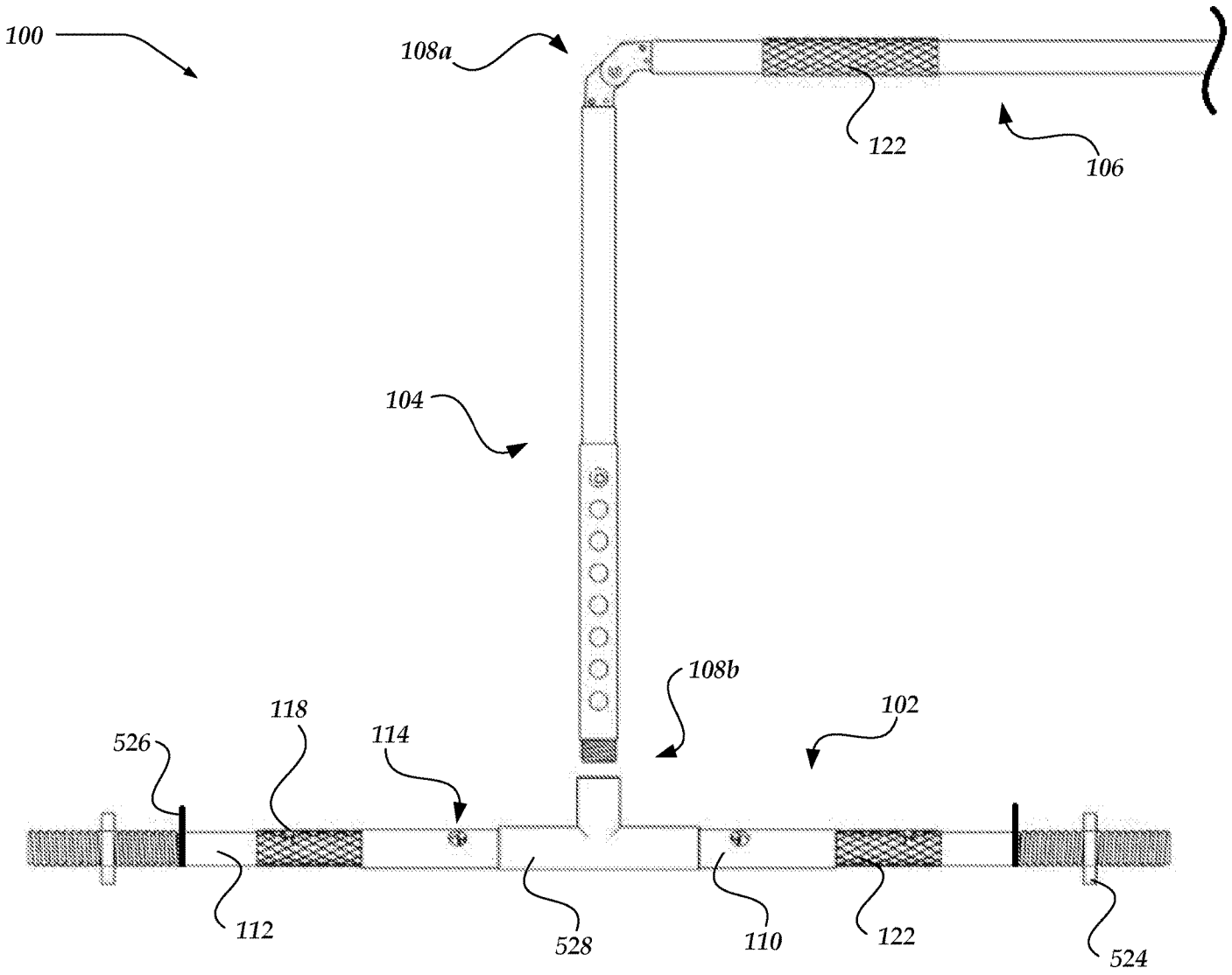
FIG. 5 shows an isometric view of a portion of the exercise apparatus of FIG. 1 with one of the longitudinal support members detached from one of the upward support members.

In one or more of the various embodiments, one or more longitudinal support members 102, upward support members 104, or lateral crossbeams 106 may include one or more telescoping tubes, thereby facilitating changing the form factor of apparatus 100 between an extended configuration (see, for example, FIG. 4) and a shortened configuration (see, for example, FIG. 1) to increase portability of the system, as well as increase the number of different exercises that may be performed with apparatus 100. In some of the various embodiments, each telescoping tube may include one or more outer tubes 110, inner tubes 112, and one or more extension locks 114, thereby facilitating securing each telescoping tube in one or more of the shortened configuration or the extended configuration to provide increased rigidity of apparatus 100 in use. In some embodiments, each outer tube 110 may house one or more portions of one or more inner tubes 112, and each inner tube 112 may be slidably expandable from within one or more outer tubes 110 into the extended configuration (for example, FIGS. 4, 5, and 7 show longitudinal support members 102 in the extended configuration, and FIGS. 2-5 and 7 show upward support members 104 in the extended configuration) and may be slidably collapsible back into one or more outer tubes 110 into the shortened configuration (for example, FIGS. 1-3, 6, 8, 9, and 10 show longitudinal support members 102 in the shortened configuration, and FIGS. 1, 6, 8, and 10 show upward support members 104 in the shortened configuration).

Figure 2:
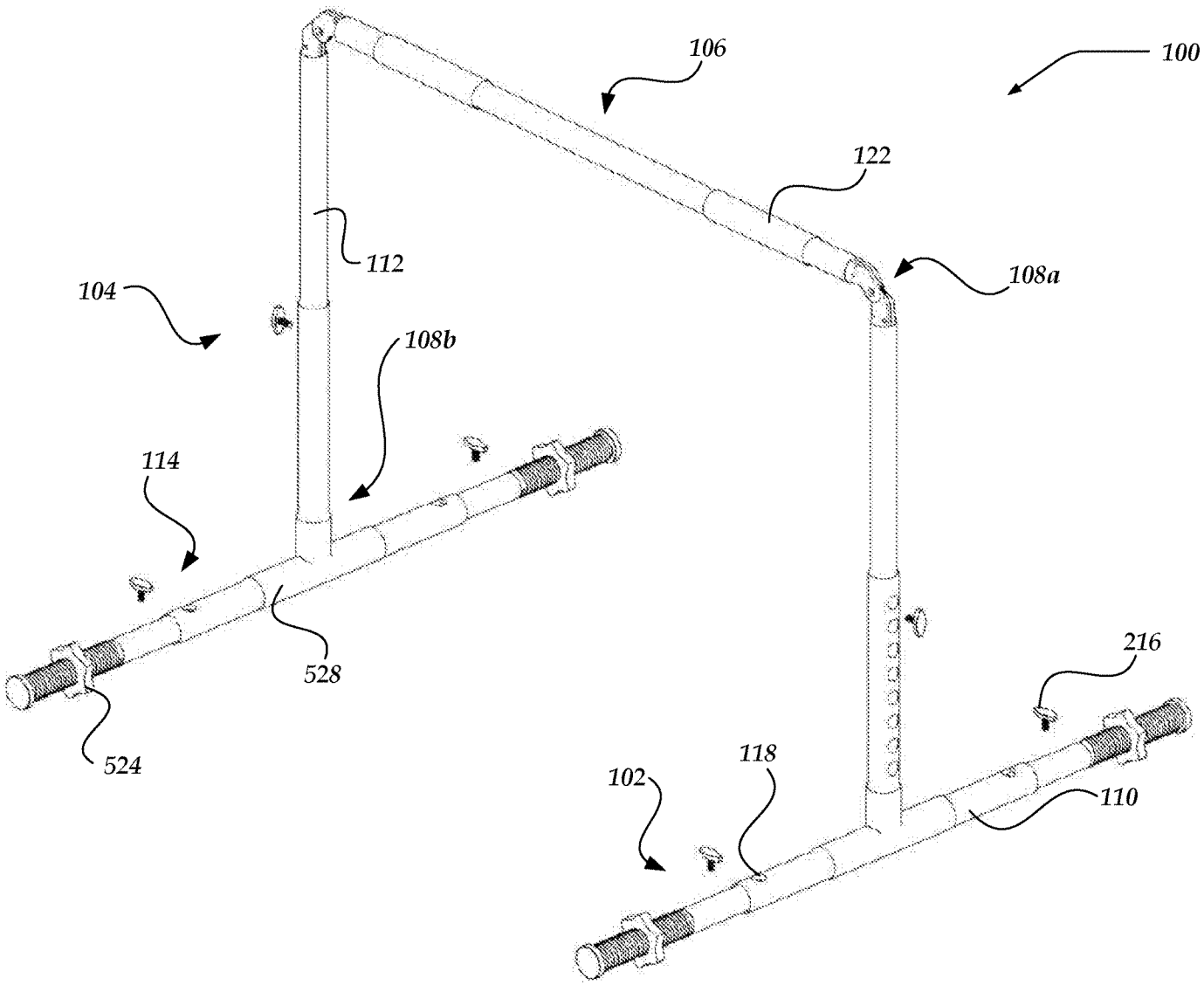
FIG. 2 illustrates an isometric view of the exercise apparatus of FIG. 1 with several pins removed from corresponding support members to demonstrate an example method of transitioning the support members between the shortened configuration and an extended configuration.

In one or more of the various embodiments, each extension lock 114 may be transitioned between a locked configuration (for example, FIGS. 1 and 3-10) and an unlocked configuration (for example, FIG. 2). In some of the various embodiments, each extension lock 114 in the locked configuration may prevent an associated telescoping tube from transitioning between the shortened configuration and the extended configuration. In some embodiments, each extension lock 114 in the unlocked configuration may facilitate transitioning an associated telescoping tube between the shortened configuration and the expanded configuration. In some embodiments, one or more locks 114 may include one or more detents, protrusions in one or more outer tubes 110 or inner tubes 112 and corresponding recessed tracks in the other of one or more outer tubes 110 or inner tubes 112, pins 216 (see, for example, FIG. 2) and corresponding receiving holes 118 in one or more associated outer tubes 110 or inner tubes 112, locking push buttons 120 and corresponding receiving holes 118 in one or more associated outer tubes 110 or inner tubes 112, or others. In some embodiments, rotating one or more inner tubes 112 relative to one or more associated outer tubes 110 may transition one or more associated locks 114 between the locked configuration and the unlocked configuration. In some embodiments, pulling one or more pins out of or inserting the one or more pins into one or more corresponding receiving holes in one or more associated outer tubes 110 or inner tubes 112 may transition one or more associated locks 114 between the locked configuration and the unlocked configuration. In some embodiments, pressing one or more push buttons 120 into one or more receiving holes 118 or releasing one or more push buttons 120 to extend through one or more receiving holes 118 may transition one or more associated locks 114 between the locked configuration and the unlocked configuration.

In one or more of the various embodiments, one or more telescoping tubes, such as upward support members 104, may have two or more lockable positions. In some of the various embodiments, two, three, four, five, six, seven, eight, or more lockable positions may be defined by as many receiving holes 118 for one or more locking push buttons or pins. In some embodiments, increasing the number of lockable positions increases the number of different exercises or variances of an exercise that may be performed using apparatus 100 or the range of user heights or body types that are supported by apparatus 100.

In one or more of the various embodiments, crossbeam 106 may have one or more handgrips 122 that facilitate improving the quality or comfort of the user's grip, at least in comparison to crossbeam 106 without handgrips 122. In some of the various embodiments, one or more handgrips 122 may include knurled engravings in crossbeam 106 or cushioning or non-slip materials that at least partially surround crossbeam 106, such as foam, rubber, or others (for example, urethane foam, urethane rubber, or others).

In one or more of the various embodiments, one or more longitudinal support members 102, upward support members 104, or lateral crossbeams 106 may include solid or hollow tubes that include one or more plastics, metals (for example, steel, aluminum, or others), fiberglass, or others. In some of the various embodiments, one or more longitudinal support members 102, upward support members 104, or lateral crossbeams 106 may include straight or curved tubes that have circular, polygonal, or other-shaped cross-sections. In some embodiments, one or more longitudinal support members 102 or lateral crossbeams 106 may have one or more curves, such as the curves in a trap bar, cambered bar, swiss bar, curl bar, or others. In some embodiments, one or more longitudinal support members 102 or lateral crossbeams 106 may include one or more weight-lifting bars, such as one or more trap bars, cambered bars, swiss bars, curl bars, dumbbells, barbells, or others. In some embodiments, one or more longitudinal support members 102 may have one or more curves that facilitate increasing stability of apparatus 100 in use, such as U-curves, S-curves, or others along the longitudinal length of one or more longitudinal support members 102 with the curves being in a plane that is parallel to the ground.

FIG. 2 illustrates an isometric view of exercise apparatus 100 with several pins 216 removed from corresponding receiving holes 118 in longitudinal support members 102 and upward support members 104 to demonstrate an example of transitioning the support members between the shortened configuration and the extended configuration. In one or more of the various embodiments, with one or more pins 216 removed (or one or more push buttons 120 are in a depressed configuration), one or more inner tubes 112 may be pulled at least partially out of one or more outer tubes 110 to extend and increase the length of one or more telescoping tubular members, such as one or more longitudinal support members 102 or upward support members 104. For example, FIG. 3 shows an isometric view of exercise apparatus 100 with upward support members 104 in the fully extended configuration, in which one or more push buttons 120 are in a locked configuration through topmost receiving holes 118.

FIG. 4 illustrates an isometric view of apparatus 100 with longitudinal support members 102 and upward support members 104 in the extended configuration. In one or more of the various embodiments, one or more longitudinal support members 102 may have one or more handgrips 122 that facilitate improving the quality or comfort of the user's grip, at least in comparison to one or more longitudinal support members 102 without handgrips 122. In some of the various embodiments, one or more handgrips 122 may be disposed in one or more inner tubes 112 of one or more longitudinal support members 102, thereby facilitating protecting the one or more handgrips 122 in the shortened configuration when handgrips 122 are not in use. In some embodiments, one or more handgrips 122 may include engravings in crossbeam 106 or cushioning or non-slip materials that at least partially surround crossbeam 106, such as foam, rubber, or others (for example, urethane foam, urethane rubber, or others).

FIG. 5 shows an isometric view of a portion of exercise apparatus 100 with one longitudinal support member 102 detached from one upward support member 104. In one or more of the various embodiments, one or more collars 524 may be separably coupled to one or more end portions of one or more longitudinal support members 102 to facilitate securing one or more weight plates to the one or more end portions. In some of the various embodiments, one or more collars 524 may include one or more Quicklee collars, spin-lock collars, clamp collars, screw-on collars, pressure collars, or others. In some embodiments, the one or more end portions of one or more longitudinal support members 102 may have one or more threads to facilitate separably coupling one or more collars 524 to the one or more end portions. In some embodiments, the one or more end portions may have one or more roller bearing housings or sleeves. In some embodiments, one or more collars 524 may include one or more plastics, rubbers, metals, or others. In some embodiments, one or more collars 524 may be chrome plated.

In one or more of the various embodiments, the one or more end portions of one or more longitudinal support members 102 may have an outer diameter that is smaller than an inner diameter of one or more holes in one or more weight plates, thereby facilitating sliding the one or more weight plates onto the one or more end portions of one or more longitudinal support members 102. In some of the various embodiments, one or more middle portions of one or more longitudinal support members 102 may have an outer diameter that is larger than the inner diameter of one or more holes in one or more weight plates and that is larger than the outer diameter of the one or more end portions of one or more longitudinal support members 102, thereby facilitating separably securing one or more weight plates between the one or more middle portions and one or more collars 524.

In one or more of the various embodiments, one or more blocker flanges 526 may radially extend from one or more longitudinal support members 102 at a location that is inward from the one or more end portions, thereby facilitating separably securing one or more weight plates between the one or more blocker flanges 526 and one or more collars 524. In some of the various embodiments, one or more blocker flanges 526 may form a circular shape that may extend outward by an equal distance along the entire outer circumference of one or more longitudinal support members 102. In some embodiments, one or more blocker flanges 526 may extend outward by a shorter distance (or not at all) from a bottom portion of one or more longitudinal support members 102, thereby facilitating preventing one or more blocker flanges 526 from disrupting stability of apparatus 100 when one or more longitudinal support members 102 are in the deployed configuration. In some embodiments, one or more blocker flanges 526 may have one or more horizontal bottom surfaces that are parallel to the floor when apparatus 100 is at rest on the ground (for example, a semi-circular shape, rectangular shape, or others), thereby facilitating increasing the stability of apparatus 100.

In one or more of the various embodiments, one or more receiving holes 118 may be disposed in one or more handgrips 122 in one or more longitudinal support members 102 to facilitate securing one or more inner tubes 112 in the shortened configuration. In some of the various embodiments, one or more separable couplings **108*b* may include one or more pipe clamps (for example, one or more snap pipe clamps that surround one or more longitudinal support members 102 or others), saddle tees, pipe clip Ts, T-pipes 528, or others. In some embodiments, one or more T-pipes 528 may have one or more top portions that may couple to one or more distal end portions of one or more upward support members 104 by Snap-fit, interference fit, threaded coupling, or others. In some embodiments, one or more T-pipes 528 may have male or female threads at one or more top portions to facilitate threadably coupling to one or more male or female threaded distal end portions of one or more upward support members 104. In some embodiments, one or more T-pipes 528 may be coupled to one or more telescoping tubes of one or more longitudinal support members 102. In some embodiments, one or more outer tubes 110 may freely rotate within one or more T-pipes 528. In some embodiments, one or more outer tubes 110 may be rotationally fixed relative to one or more T-pipes 528. In some embodiments, one or more T-pipes 528 may include or be integral to one or more outer tubes 110. In some embodiments, one or more separable couplings In one or more of the various embodiments, one or more hingeable couplings 108*a* may include one or more hinges with one or more detents or other locking mechanisms (for example, one or more pins 216 and one or more receiving holes 118, push buttons 120 and one or more receiving holes 118, or others) that facilitate maintaining the orientation of each crossbeam 106 relative to each hingeably coupled upward support member 104**, absent intentional human interaction with the one or more detents or other locking mechanisms, at least when in the deployed configuration. In some of the various embodiments, a hinge may include a locking pin and two or more hinge plates that are hingeably coupled to each other, with one or more of the hinge plates including a receiving hole into which the locking pin may be inserted to lock the hinge plates relative to each other and from which the locking pin may be removed to permit swiveling the hinge plates relative to each other.

In one or more of the various embodiments, one or more end portions of one or more hingeable couplings **108*a* may be integral, separably coupled, or fixedly coupled to one or more crossbeams 106, upward support members 104, or longitudinal support members 102. In some of the various embodiments, one or more end portions of one or more hingeable couplings 108*a* may be sized and dimensioned to correspond to the inner walls of one or more end portions of one or more crossbeams 106, upward support members 104, or longitudinal support members 102 to facilitate receiving the one or more end portions of one or more hingeable couplings 108*a* in the one or more end portions of one or more crossbeams 106, upward support members 104, or longitudinal support members 102. In some embodiments, the one or more end portions of one or more hingeable couplings 108*a* may couple to the one or more end portions of one or more crossbeams 106, upward support members 104, or longitudinal support members 102 with one or more of Snap-fit, interference fit, threaded coupling, or others. In some embodiments, one or more pins 216 or push buttons 120, in conjunction with one or more corresponding receiving holes 118, may separably secure the one or more end portions of one or more hingeable couplings 108*a* to the one or more end portions of one or more crossbeams 106, upward support members 104, or longitudinal support members 102**.

Figure 6:
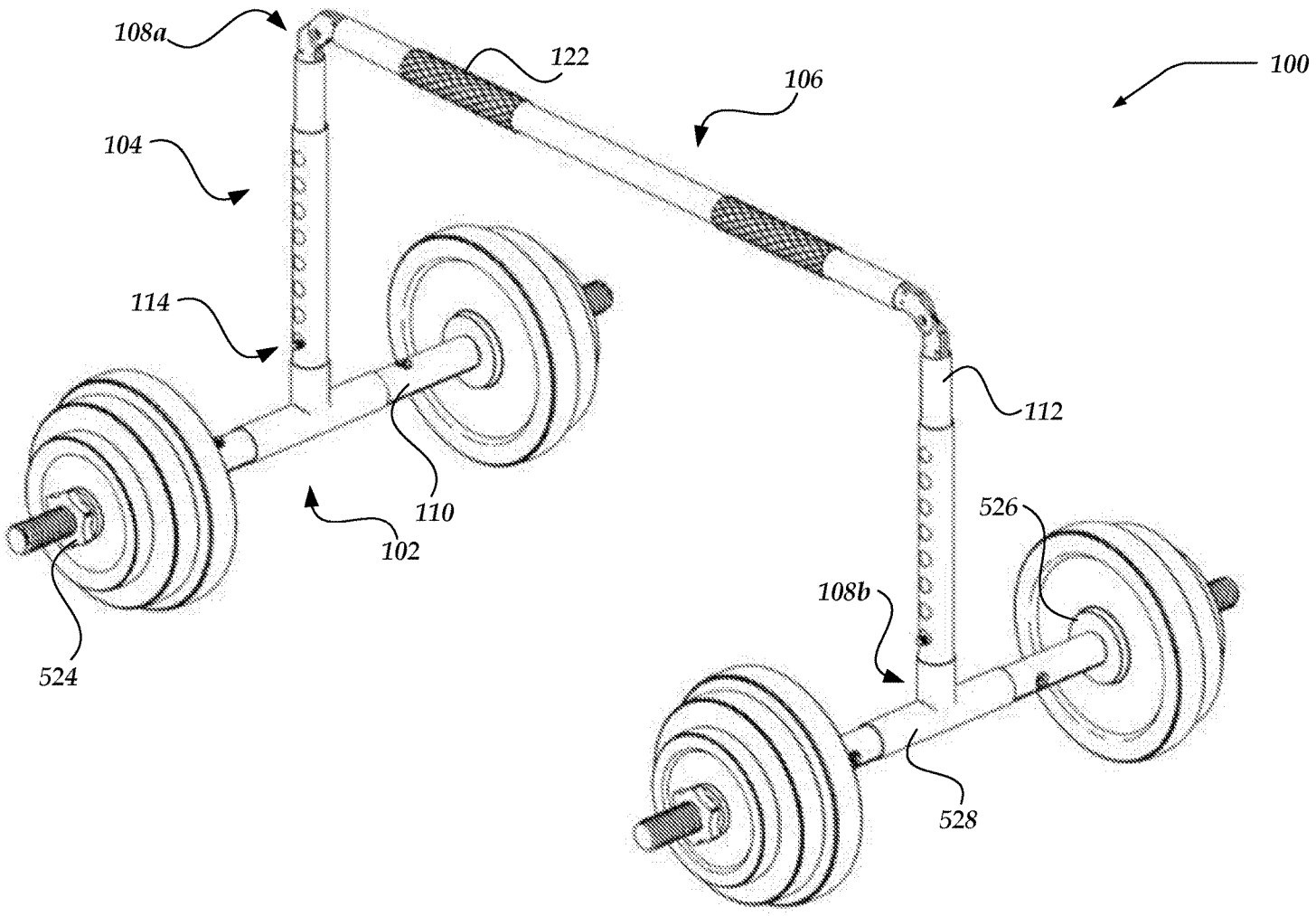
FIG. 6 illustrates an isometric view of the exercise apparatus of FIG. 1 with weight plates separably coupled to the longitudinal support members.
Figure 7:
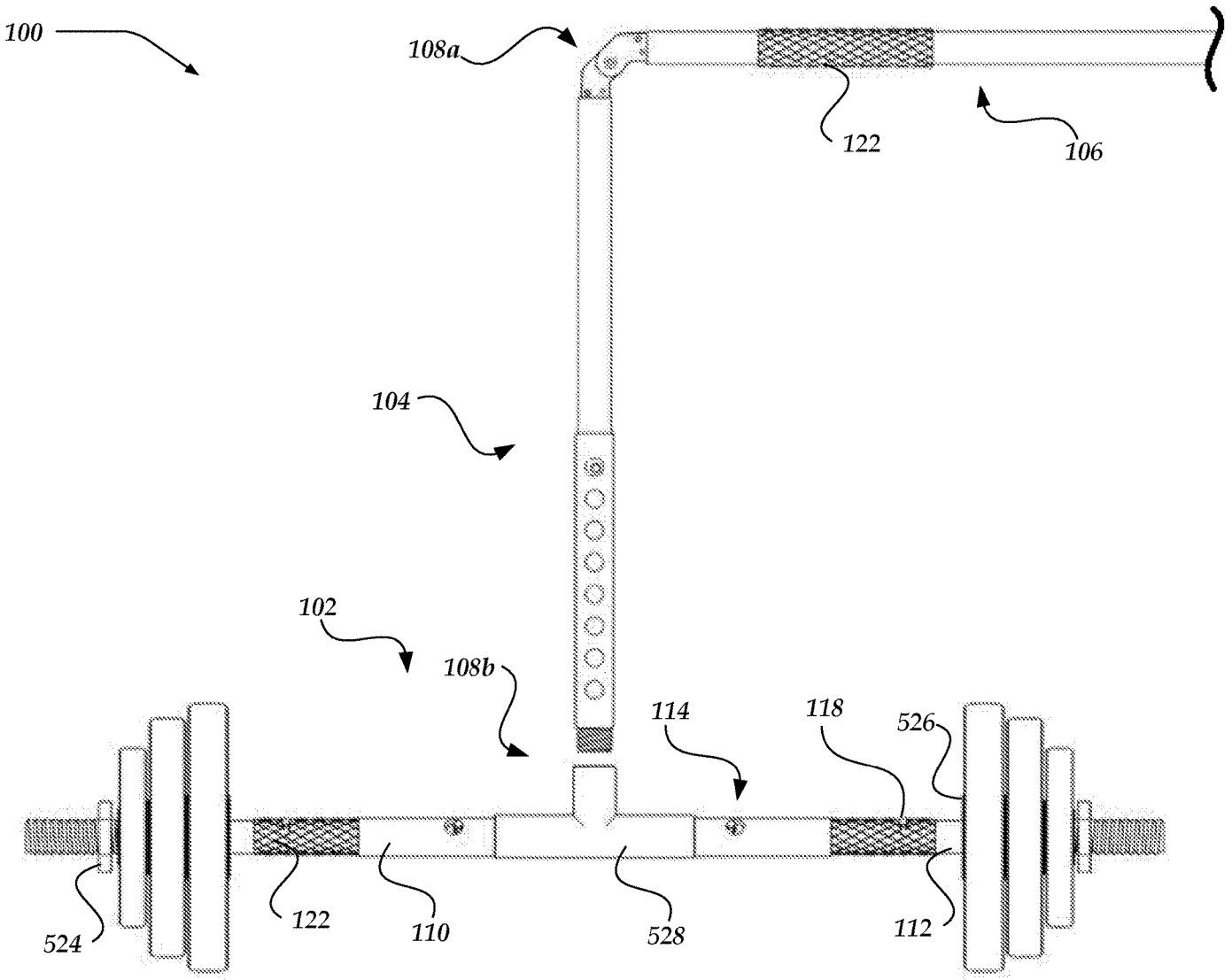
FIG. 7 shows an isometric view of a portion of the exercise apparatus of FIG. 1 with weight plates separably coupled to one of the longitudinal support members and with the longitudinal support member detached from one of the upward support members.

FIG. 6 illustrates an isometric view of exercise apparatus 100 in the deployed configuration with weight plates separably coupled to longitudinal support members 102 and with longitudinal support members 102 coupled to upward support members 104. In one or more of the various embodiments, various weight-lifting exercises may be performed using apparatus 100 in the deployed configuration with weight plates separably coupled to longitudinal support members 102. For example, the user may employ apparatus to emulate a barbell by laying on the user's back with the user's chest positioned under lateral crossbeam 106 and with the user's spine being parallel to one or more longitudinal support members 102, gripping one or more handgrips 122 of lateral crossbeam 106, lifting apparatus 100 to perform bench press exercises.

FIG. 7 shows an isometric view of a portion of exercise apparatus 100 with weight plates separably coupled to one or more longitudinal support members 102 that are detached from one or more upward support members 104. In one or more of the various embodiments, with one or more longitudinal support members 102 separated from one or more upward support members 104, the user may employ one or more longitudinal support members 102 as a dumbbell to perform various weight-lifting exercises, such as curls, tricep extensions, or others.

Figure 8:
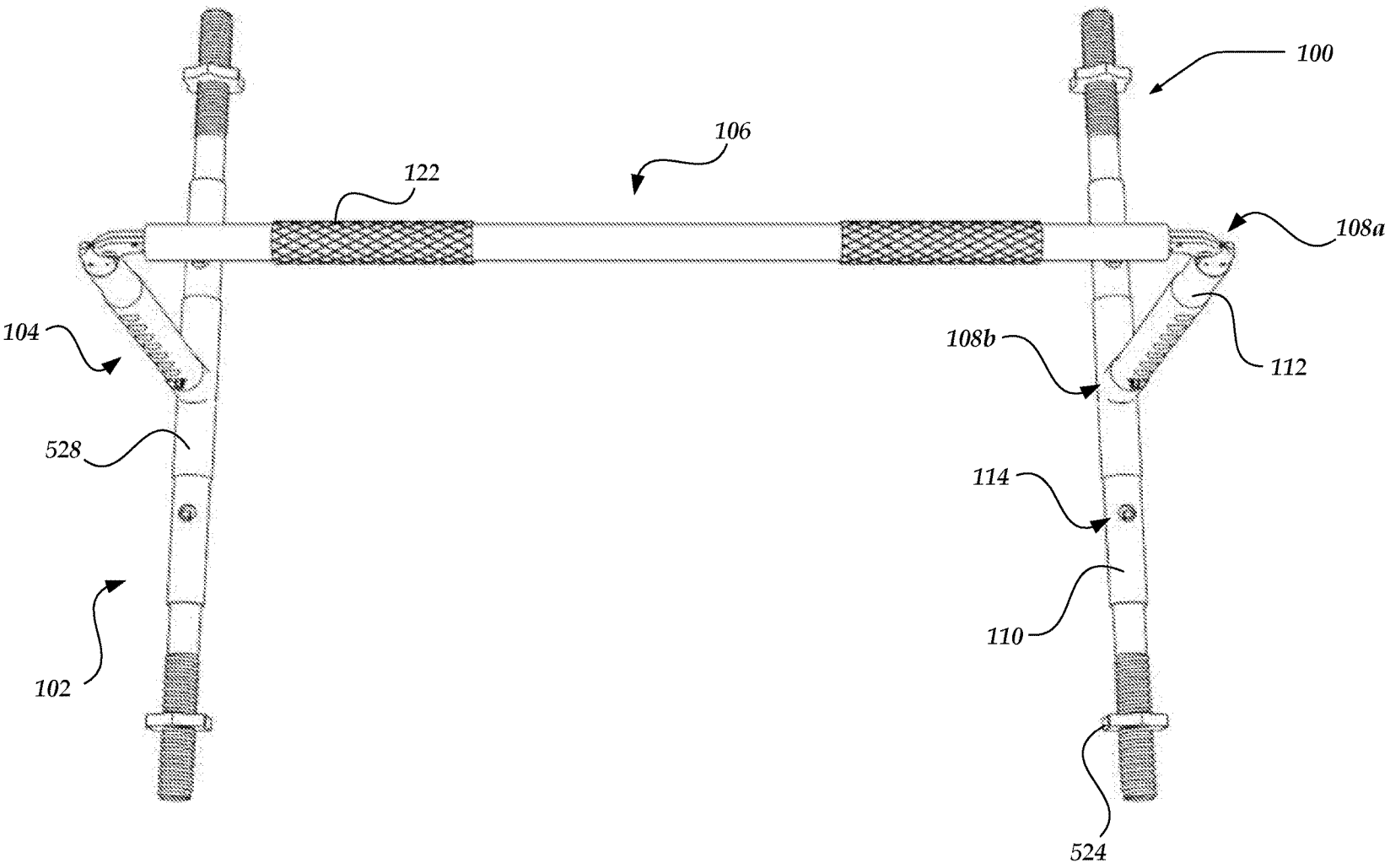
FIG. 8 illustrates an isometric view of the exercise apparatus of FIG. 1 with the apparatus in the deployed configuration and each of the support members in the shortened configuration.
Figure 9:
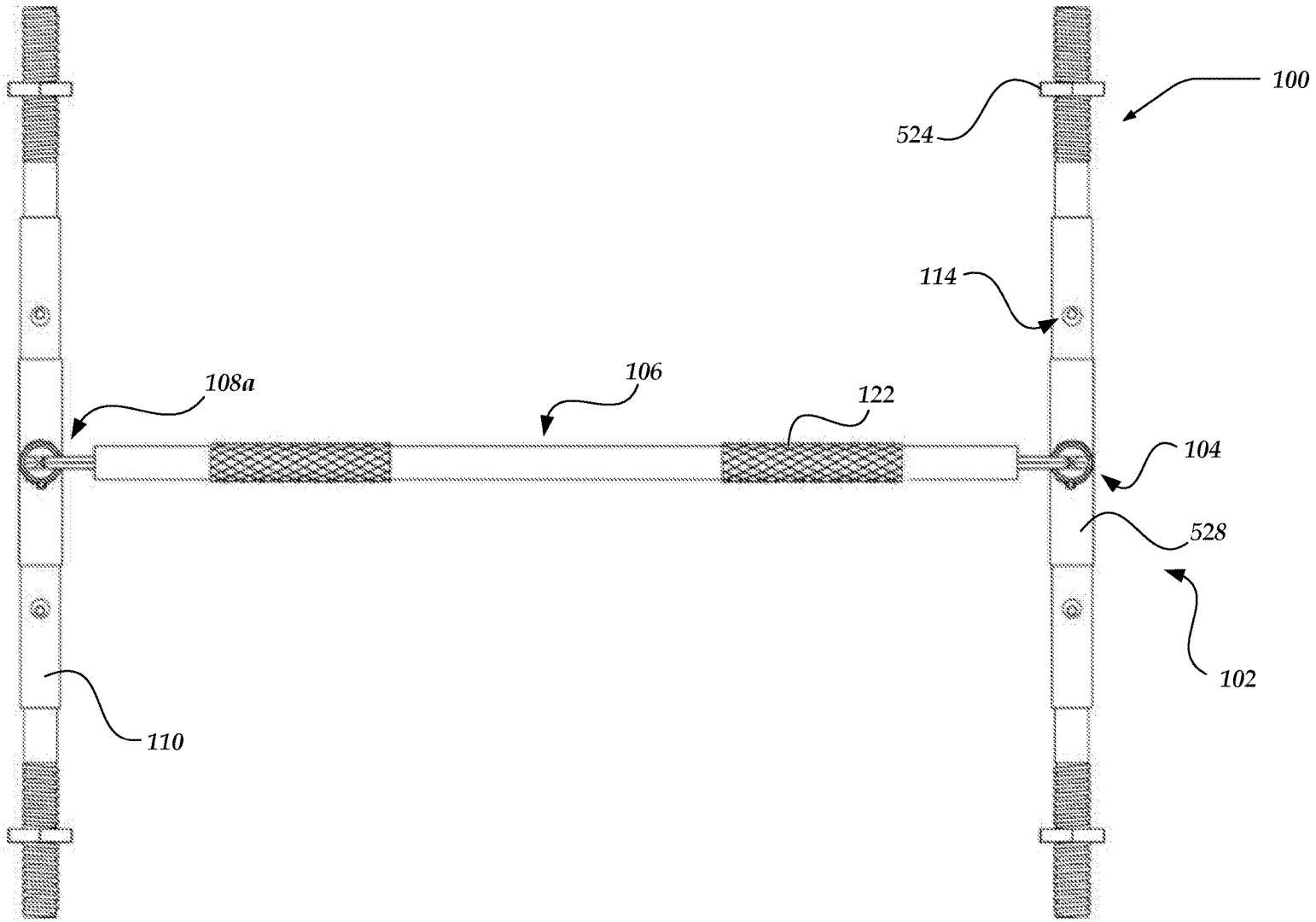
FIG. 9 shows an isometric view of the exercise apparatus of FIG. 1 with the apparatus in the deployed configuration and at least each of the longitudinal support members in the shortened configuration.

FIG. 8 illustrates an isometric view of exercise apparatus 100 with apparatus 100 in the deployed configuration and each of the support members in the shortened configuration. FIG. 9 shows an isometric view of exercise apparatus 100 with apparatus 100 in the deployed configuration and at least each longitudinal support member 102 in the shortened configuration. In one or more of the various embodiments, the user may grip one or more handgrips 122 in lateral crossbeam 106 and engage in various bodyweight exercises, such as seated dips, elevated pushups, modified pullups, crunches, side crunches, or others. In some of the various embodiments, the user may vary the height of one or more upward support members 104 to facilitate increasing or decreasing the difficulty of one or more exercises, changing the left-to-right balance of one or more exercises, or accommodating the user's height or body shape.

Figure 10:
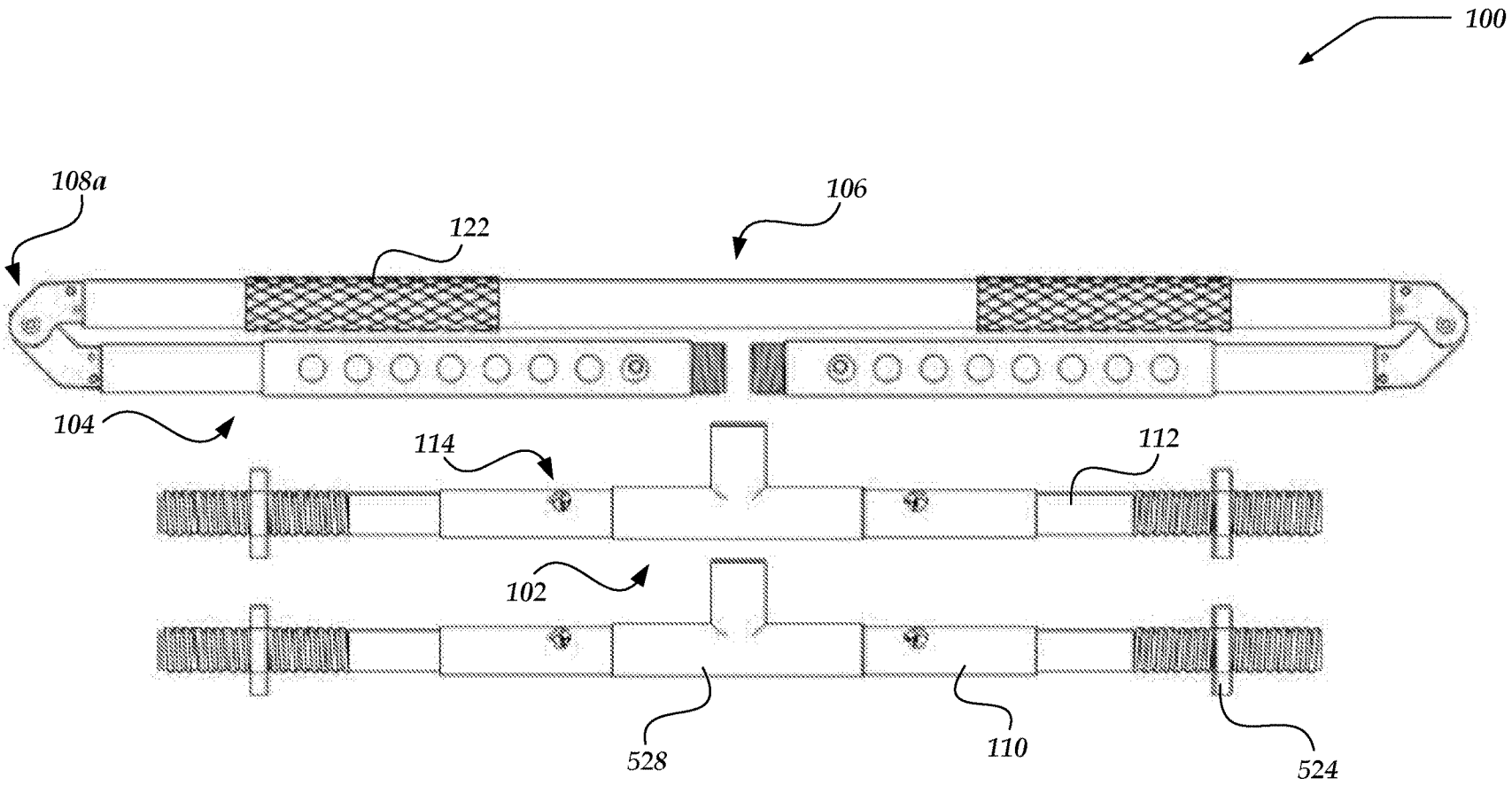
FIG. 10 illustrates an isometric view of the exercise apparatus of FIG. 1 with the apparatus in a collapsed configuration.

FIG. 10 illustrates an isometric view of exercise apparatus 100 with apparatus 100 in the collapsed configuration. In one or more of the various embodiments, one or more crossbeams 106 in the deployed configuration may have a length of 24, 26, 28, 30, 32, 34, 36, 38, 40, 42, 44, 46, 48, 50, or more inches. In some of the various embodiments, one or more upward support members 104 in the extended configuration may have a length of 24, 26, 28, 30, 32, 34, 36, 38, 40, 42, 44, 46, 48, 50, or more inches. In some embodiments, one or more longitudinal support members 102 in the extended configuration may have a length of 24, 26, 28, 30, 32, 34, 36, 38, 40, 42, 44, 46, 48, 50, or more inches. In some embodiments, one or more crossbeams 106 may include one or more telescoping tubes or may include one or more separable or hingeable couplings 108 in a middle portion of one or more crossbeams 106, thereby facilitating decreasing the length of one or more crossbeams 106 in the collapsed configuration.

The terms "top," "bottom," "up," "down," and variants thereof are used consistently with respect to all elements and are defined relative to crossbeam 106 in the deployed configuration. The term "down" refers to the direction of a path from crossbeam 106 in the deployed configuration to the ground when the bottom surface of each longitudinal support member 102 engages the ground. The terms "proximal," "distal," and variants thereof are used consistently with respect to all elements and are defined relative to crossbeam 106. The term "proximal" refers to portions that are closer to crossbeam 106 in the deployed configuration, and the term "distal" refers to portions that are further from crossbeam 106 than the proximal portions in the deployed configuration. The terms "longitude," "lateral," "height," and variants thereof are also used consistently with respect to all elements and are defined relative to the lateral axis of crossbeam 106. The lateral axis of crossbeam 106 in the deployed configuration extends along the longitudinal center of crossbeam 106 from one end portion of crossbeam 106 to an opposite end portion of crossbeam 106. The longitudinal axis of longitudinal support member 102 is transverse to the lateral axis of crossbeam 106 and extends along the lateral center of longitudinal support member 102. The height of upward support member 104 in the deployed configuration is transverse to the longitudinal axis of longitudinal support member 102 and the lateral axis of crossbeam 106.

The foregoing examples should not be construed as limiting or exhaustive, yet rather, illustrative use cases to show implementations of at least one of the various embodiments of the invention. Accordingly, many changes can be made without departing from the spirit and scope of the invention. Thus, the scope of the invention is not limited by the disclosure of the examples. Instead, the invention should be determined entirely by reference to the claims that follow.

The embodiments of the invention in which an exclusive property or privilege is claimed are defined as follows:

1. An exercise equipment apparatus for performing bodyweight exercises, comprising:

a lateral crossbeam having a first end portion and a second end portion opposite the first end portion;

a first upward support member having a first proximal end portion and a first distal end portion, the first proximal end portion of the first upward support member extending from the first end portion of the lateral crossbeam;

a second upward support member having a second proximal end portion and a second distal end portion, the second proximal end portion of the second upward support member extending from the second end portion of the lateral crossbeam;

a first T-shaped support member having first and second horizontally extending portions that are substantially parallel to each other and a first upwardly extending portion that is disposed between the first and second horizontally extending portions and substantially perpendicular to the first and second horizontally extending portions, the first upwardly extending portion of the first T-shaped support member coupling to the first distal end portion of the first upward support member;

a second T-shaped support member having third and fourth horizontally extending portions that are substantially parallel to each other and a second upwardly extending portion that is disposed between the third and fourth horizontally extending portions and substantially perpendicular to the third and fourth horizontally extending portions, the second upwardly extending portion of the second T-shaped support member coupling to the second distal end portion of the second upward support member;

a first extension lock that is configured to transition between a locked configuration and an unlocked configuration, the first extension lock in the unlocked configuration being configured to enable a user to adjust a distance between the first T-shaped support member and the lateral crossbeam, the first extension lock in the locked configuration being configured to maintain the distance between the first T-shaped support member and the lateral crossbeam; and a second extension lock that is configured to transition between the locked configuration and the unlocked configuration, the second extension lock in the unlocked configuration being configured to enable the user to adjust a distance between the second T-shaped support member and the lateral crossbeam, the second extension lock in the locked configuration being configured to maintain the distance between the second T-shaped support member and the lateral crossbeam, wherein the first and second T-shaped support members are configured to transition between a first configuration in which the first, second, third, and fourth horizontally extending portions are substantially horizontal and substantially perpendicular to the lateral crossbeam and a second configuration in which the first, second, third, and fourth horizontally extending portions are substantially horizontal and substantially parallel to the lateral crossbeam, the first T-shaped support member being in contact with the first upward support member in the first configuration and the second configuration, the second T-shaped support member being in contact with the second upward support member in the first configuration and the second configuration, the first and second upward support members extending from the lateral crossbeam in the first configuration and the second configuration, whereby the exercise equipment apparatus facilitates the user performing different body-weight exercises or different variants of body-weight exercises with various distances between the lateral crossbeam and the first and second T-shaped support members, and whereby the first and second T-shaped support members improve stability of the exercise equipment apparatus in the first configuration and facilitate storing the exercise equipment apparatus in the second configuration.

2. The exercise equipment apparatus of claim 1, wherein the first upward support member defines a first one of a first outer tube or a first inner tube and the first upwardly extending portion defines a second one of the first outer tube or the first inner tube, and the second upward support member defines a first one of a second outer tube or a second inner tube and the second upwardly extending portion defines a second one of the second outer tube or the second inner tube, only one of the first upward support member or the first upwardly extending portion defining the first outer tube, only one of the first upward support member or the first upwardly extending portion defining the first inner tube, only one of the second upward support member or the second upwardly extending portion defining the second outer tube, only one of the second upward support member or the second upwardly extending portion defining the second inner tube, the first outer tube being configured to receive the first inner tube inside the first outer tube, the second outer tube being configured to receive the second inner tube inside the first outer tube.

3. The exercise equipment apparatus of claim 2, wherein the first outer tube and the first inner tube define a first telescoping tube that is configured to transition between a shortened configuration and an extended configuration, and the second outer tube and the second inner tube define a second telescoping tube that is configured to transition between the shortened configuration and the extended configuration, whereby a number of different body-weight exercises or different variants of body-weight exercises available to the user to perform with the exercise equipment apparatus is increased.

4. The exercise equipment apparatus of claim 3, wherein the first extension lock secures the first T-shaped support member to the first upwardly extending portion, and the second extension lock secures the second T-shaped support member to the second upwardly extending support.

5. The exercise equipment apparatus of claim 4, wherein the first upward support member defines the first inner tube, the first upwardly extending portion defines the first outer tube, the second upward support member defines the second inner tube, and the second upwardly extending portion defines the second outer tube.

6. The exercise equipment apparatus of claim 3, wherein the first extension lock in the locked configuration contacts the first upward support member and the first upwardly extending portion, and the second extension lock in the locked configuration contacts the second upward support member and the second upwardly extending portion.

7. The exercise equipment apparatus of claim 6, wherein the lateral crossbeam has a major axis that extends from the first end portion to the second end portion, and the first, second, third, and fourth horizontally extending portions have non-circular cross-sections in respective vertical planes that extend parallel to the major axis of the lateral crossbeam.

8. The exercise equipment apparatus of claim 6, wherein the first upward support member or the first upwardly extending portion defines a first plurality of vertically spaced apart receiving holes that are configured to receive the first extension lock, and the second upward support member or the second upwardly extending portion defines a second plurality of vertically spaced apart receiving holes that are configured to receive the second extension lock, whereby the first and second pluralities of vertically spaced apart receiving holes predefine the various distances to facilitate the user performing the different body-weight exercises or the different variants of body-weight exercises.

9. The exercise equipment apparatus of claim 8, wherein the first extension lock includes a first pin that is configured to be received by the first plurality of receiving holes to provide the locked configuration and to separate from all other components of the exercise equipment apparatus to provide the unlocked configuration, and the second extension lock includes a second pin that is configured to be received by the second plurality of receiving holes to provide the locked configuration and to separate from all other components of the exercise equipment apparatus to provide the unlocked configuration.

10. The exercise equipment apparatus of claim 8, wherein the first extension lock includes a first push button that is configured to be received by the first plurality of receiving holes to provide the locked configuration and to be pushed out of one of the first plurality of receiving holes to provide the unlocked configuration, and the second extension lock includes a second push button that is configured to be received by the second plurality of receiving holes to provide the locked configuration and to be pushed out of one of the second plurality of receiving holes to provide the unlocked configuration.

11. The exercise equipment apparatus of claim 8, wherein the lateral crossbeam has a major axis that extends from the first end portion to the second end portion, and the first, second, third, and fourth horizontally extending portions have polygonal cross-sections in respective vertical planes that extend parallel to the major axis of the lateral crossbeam.

12. The exercise equipment apparatus of claim 8, wherein the lateral crossbeam has a handgrip.

13. A method of exercising, comprising:

providing an exercise equipment apparatus of claim 6; and coupling the first T-shaped support member to the first distal end portion of the first upward support member;

coupling the second T-shaped support member to the second distal end portion of the second upward support member;

transitioning the first extension lock to the locked configuration while the first T-shaped support member is disposed at a first distance from the lateral crossbeam;

transitioning the second extension lock to the locked configuration while the second T-shaped support member is disposed at the first distance from the lateral crossbeam;

gripping the crossbeam with the first T-shaped support member coupled to the distal end portion of the first upward support member at the first distance and with the second T-shaped support member coupled to the distal end portion of the second upward support member at the first distance;

repeatedly pulling or pushing on the gripped crossbeam to repeatedly move a human body toward or away from the crossbeam with the first T-shaped support member coupled to the distal end portion of the first upward support member at the first distance and with the second T-shaped support member coupled to the distal end portion of the second upward support member at the first distance;

transitioning the first extension lock to the unlocked configuration;

transitioning the second extension lock to the unlocked configuration;

transitioning the first extension lock to the locked configuration while the first T-shaped support member is disposed at a second distance from the lateral crossbeam that is different than the first distance;

transitioning the second extension lock to the locked configuration while the second T-shaped support member is disposed at the second distance from the lateral crossbeam;

gripping the crossbeam with the first T-shaped support member coupled to the distal end portion of the first upward support member at the second distance and with the second T-shaped support member coupled to the distal end portion of the second upward support member at the second distance; and repeatedly pulling or pushing on the gripped crossbeam to repeatedly move the human body toward or away from the crossbeam with the first T-shaped support member coupled to the distal end portion of the first upward support member at the second distance and with the second T-shaped support member coupled to the distal end portion of the second upward support member at the second distance.

14. The method of claim 13, further comprising transitioning the first and second T-shaped support members from the first configuration to the second configuration and storing the exercise equipment apparatus.

15. The method of claim 14, wherein the first outer tube and the first inner tube define a first telescoping tube that is configured to transition between a shortened configuration and an extended configuration, and the second outer tube and the second inner tube define a second telescoping tube that is configured to transition between the shortened configuration and the extended configuration, whereby a number of different body-weight exercises or different variants of body-weight exercises available to the user to perform with the exercise equipment apparatus is increased.

16. The method of claim 15, wherein the first extension lock secures the first T-shaped support member to the first upwardly extending portion, and the second extension lock secures the second T-shaped support member to the second upwardly extending support.

17. The method of claim 16, wherein the first upward support member defines the first inner tube, the first upwardly extending portion defines the first outer tube, the second upward support member defines the second inner tube, and the second upwardly extending portion defines the second outer tube.

18. The method of claim 17, wherein the lateral crossbeam has a major axis that extends from the first end portion to the second end portion, and the first, second, third, and fourth horizontally extending portions have non-circular cross-sections in respective vertical planes that extend parallel to the major axis of the lateral crossbeam.

19. The exercise equipment apparatus of claim 6, wherein the first upward support member or the first upwardly extending portion defines a first plurality of vertically spaced apart receiving holes that are configured to receive the first extension lock, and the second upward support member or the second upwardly extending portion defines a second plurality of vertically spaced apart receiving holes that are configured to receive the second extension lock, whereby the first and second pluralities of vertically spaced apart receiving holes predefine the various distances to facilitate the user performing the different body-weight exercises or the different variants of body-weight exercises.

20. The exercise equipment apparatus of claim 19, wherein the first extension lock includes a first pin that is configured to be received by the first plurality of receiving holes to provide the locked configuration and to separate from all other components of the exercise equipment apparatus to provide the unlocked configuration, and the second extension lock includes a second pin that is configured to be received by the second plurality of receiving holes to provide the locked configuration and to separate from all other components of the exercise equipment apparatus to provide the unlocked configuration.

21. The exercise equipment apparatus of claim 19, wherein the first extension lock includes a first push button that is configured to be received by the first plurality of receiving holes to provide the locked configuration and to be pushed out of one of the first plurality of receiving holes to provide the unlocked configuration, and the second extension lock includes a second push button that is configured to be received by the second plurality of receiving holes to provide the locked configuration and to be pushed out of one of the second plurality of receiving holes to provide the unlocked configuration.

22. The exercise equipment apparatus of claim 19, wherein the lateral crossbeam has a major axis that extends from the first end portion to the second end portion, and the first, second, third, and fourth horizontally extending portions have polygonal cross-sections in respective vertical planes that extend parallel to the major axis of the lateral crossbeam.

23. The exercise equipment apparatus of claim 19, wherein the lateral crossbeam has a handgrip.

24. A method of exercising, comprising:

providing an exercise equipment apparatus of claim 1; and coupling the first T-shaped support member to the first distal end portion of the first upward support member;

coupling the second T-shaped support member to the second distal end portion of the second upward support member;

transitioning the first extension lock to the locked configuration while the first T-shaped support member is disposed at a first distance from the lateral crossbeam;

transitioning the second extension lock to the locked configuration while the second T-shaped support member is disposed at the first distance from the lateral crossbeam;

gripping the crossbeam with the first T-shaped support member coupled to the distal end portion of the first upward support member at the first distance and with the second T-shaped support member coupled to the distal end portion of the second upward support member at the first distance;

repeatedly pulling or pushing on the gripped crossbeam to repeatedly move a human body toward or away from the crossbeam with the first T-shaped support member coupled to the distal end portion of the first upward support member at the first distance and with the second T-shaped support member coupled to the distal end portion of the second upward support member at the first distance;

transitioning the first extension lock to the unlocked configuration;

transitioning the second extension lock to the unlocked configuration;

transitioning the first extension lock to the locked configuration while the first T-shaped support member is disposed at a second distance from the lateral crossbeam that is different than the first distance;

transitioning the second extension lock to the locked configuration while the second T-shaped support member is disposed at the second distance from the lateral crossbeam;

gripping the crossbeam with the first T-shaped support member coupled to the distal end portion of the first upward support member at the second distance and with the second T-shaped support member coupled to the distal end portion of the second upward support member at the second distance;

repeatedly pulling or pushing on the gripped crossbeam to repeatedly move the human body toward or away from the crossbeam with the first T-shaped support member coupled to the distal end portion of the first upward support member at the second distance and with the second T-shaped support member coupled to the distal end portion of the second upward support member at the second distance;

transitioning the first and second T-shaped support members from the first configuration to the second configuration; and while the first and second T-shaped support members are disposed in the second configuration, storing the exercise equipment apparatus.

* * * * *